US007063016B2

(12) United States Patent
Bitton

(10) Patent No.: US 7,063,016 B2
(45) Date of Patent: Jun. 20, 2006

(54) METHOD FOR REGISTRATION OF FERROMAGNETIC METAL BASE PRINTING PLATES ON AN EXTERNAL MAGNETIC DRUM IMAGESETTER

(75) Inventor: Michel Bitton, Pardessia (IL)

(73) Assignee: Creo IL. Ltd., Herzlia Pituah (IL)

( * ) Notice: Subject to any disclaimer, the term of this patent is extended or adjusted under 35 U.S.C. 154(b) by 49 days.

(21) Appl. No.: 10/921,126

(22) Filed: Aug. 19, 2004

(65) Prior Publication Data

US 2005/0056174 A1 Mar. 17, 2005

Related U.S. Application Data

(60) Provisional application No. 60/503,476, filed on Sep. 17, 2003.

(51) Int. Cl.
*B41F 27/02* (2006.01)

(52) U.S. Cl. ..... 101/389.1; 101/477; 101/486; 33/618; 33/623

(58) Field of Classification Search ..... 101/389.1, 101/477, 401.1, 481, 485, 486, 479, 480, 101/DIG. 36; 33/614, 617, 618, 621, 623
See application file for complete search history.

(56) References Cited

U.S. PATENT DOCUMENTS

| | | | | |
|---|---|---|---|---|
| 4,727,806 | A * | 3/1988 | Green, Sr. | 101/415.1 |
| 4,809,609 | A * | 3/1989 | Sugiura et al. | 101/485 |
| 5,136,945 | A * | 8/1992 | Kawazoe | 101/389.1 |
| 5,155,921 | A * | 10/1992 | Banike | 33/618 |
| 6,925,936 | B1 * | 8/2005 | Gottschalt et al. | 101/477 |

* cited by examiner

*Primary Examiner*—Leslie J. Evanisko

(57) ABSTRACT

Apparatus and method for registration and loading of ferromagnetic metal-based printing plates to a magnetic drum. The apparatus comprises a magnetic cylinder equipped with registration holes; a loading table, a non-magnetic material spacer tray and at least one pair of registration pegs. The method comprises providing a magnetic cylinder equipped with registration holes, and at least one pair of registration pegs, providing a loading table and a non-magnetic material spacer tray, attaching a pre-punched ferromagnetic metal-based printing plate to said spacer tray, placing said spacer tray with attached printing plate on said loading table, sliding forward said spacer tray with attached printing plate, leading edge first, towards said magnetic cylinder, using a first registration peg to register the plate's first punched registration hole to the cylinder's corresponding first registration hole, using a second registration peg to register the plate's second punched registration hole to the cylinder's corresponding second registration hole, rotating the cylinder to wrap and attach said ferromagnetic metal-based printing plate to said magnetic cylinder, simultaneously releasing and removing said spacer tray, and removing said two registration pegs from said cylinder.

7 Claims, 6 Drawing Sheets

FIG. 1 (PRIOR-ART)

FIG. 2 (PRIOR-ART)

METHOD FOR REGISTRATION OF FERROMAGNETIC METAL BASE PRINTING PLATES ON AN EXTERNAL MAGNETIC DRUM IMAGESETTER

RELATED APPLICATION DATA

This application claims the benefit of priority from U.S. provisional patent application No. 60/503,476, filed, Sep. 17, 2003, and which is hereby incorporated by reference.

FIELD AND BACKGROUND OF THE INVENTION

Color printing requires registration of the printing plates on the cylinders of the print engine to achieve acceptable print quality. For this purpose many known in the art devices are available on the print cylinders, including, for example, registration pins and clamps. Since the early nineties certain types of printing plates can be prepared on Computer to Plate (CTP) imagesetters such as, for example, the Trendsetter by Creo Inc. of Vancouver Canada or the Lotem series by Creo IL Ltd. of Herzelia Israel. The imaging of a set of printing plates (for example, four CMYK separation plates) requires close registration as well, in purpose to achieve the quality of the printed image represented by that set of plates. This is achieved in imaging of Offset printing by the use of, for example, registration pins on the imaging cylinder of the CTP device and pre-punched registration holes in the separation plates. The use of imaging cylinder registration pins and punched holes in the imaged plates conform to the method of registration used on the corresponding printing press. The same imaging cylinder registration pins and punched holes can be further utilized for the imaging related "spiral compensation" as described in U.S. Pat. No. 6,016,752 assigned to Creo IL Ltd. of Herzelia, Israel.

Plates for flexography, used, for example in decorative printing, having a polyester base, are imaged on known in the art CTP thermal imagesetters, such as the ThermoFlex by Creo. The imaging cylinder in such CTP imagesetters got short registration pins, as will be further explained, and circumferential vacuum slots to enable firm attachment of the plate during operation.

CTP Letterpress (raised type) printing plates are available in both polyester and ferromagnetic-metal base. The polyester base plates can be imaged on the Creo Thermoflex imagesetter, but this is impractical for other types of Letterpress plates having a ferromagnetic-metal back (or base), for example, BASF of Germany model WS73D used, for example, in printing on metal cans. Such plates are much heavier and require better attachment to the cylinder means as to prevent the centrifugal forces to tear the plate from the fast rotating cylinder and cause damage to the imagesetter. While mechanical plate clamps, as known in the art, can not be used for reasons to be further explained, and vacuum holding is not safe, a good solution is to use a "magnetic imaging cylinder" (or "magnetic drum") as part of the system. The known in the art "magnetic cylinder", used in certain printing presses, enables effective attachment and holding of ferromagnetic metal-based plates during the imaging operation. FIG. 1 depicts schematically a known in the art "magnetic drum" 10 as used, for example, in Letterpress printing devices. The cylinder 11 is made of non-magnetic material, in which rows of magnets 16 are embedded. These magnets 16 keep the ferromagnetic-metal backed plate firmly attached to the rotating cylinder during normal operation. To enable correct registration of the plate on the drum registration pins 14 are available as known in the art. Additional strong bar magnets 12 are optionally embedded in the non-magnetic cylinder, in the same row and next to the registration pins 14, to ensure firm attachment of the plate's leading and trailing edges.

A typical Letterpress printing plate 20, of the polyester or ferromagnetic metal back types, is shown schematically in FIG. 2, wherein the relief thermal imaging polymer layer 22 got a back (or base) 24 of polyester or ferromagnetic metal. Typically the Relief 22 depth Dp is thicker than the ferromagnetic-metal base 24, for example:

A BASF (Germany) Letterpress steel backed plate, type WS73D got a Relief depth of Dp=0.65 mm and a base of Ds=0.27 mm.

The thermal imaging process, requiring a good focus of the imaging energy on the Relief part, dictates the use of an automatic focus device as known in the art. During the automatic focusing operation the imaging head (not shown in FIG. 2) must be able to approach the surface 26 of the relief layer 22, which dictates a severe limitation that no mechanical obstacle, including registration pins, should protrude more than (for a specific imagesetter, as an example) about 0.5 mm above the plate surface 26 of the least thick Letterpress plate in use. Having short registration pins 14 on a "magnetic drum" 10 combined with the strong magnetic forces of magnets 16 in the area of the registration pins create a severe limitation on the maneuverability of the plate's leading edge during a manual attempt to register the plate on the imaging cylinder, as the magnets 14 "snatch" and lock the ferromagnetic metal base of the plate as soon as the gap between magnets and metal base narrows sufficiently. A similar problem occurs in printing presses, having a "magnetic printing cylinder". According to one prior art method of overcoming the above mentioned difficulties, the entire "magnetic printing cylinder" is removed from the press to an external "registration table" where the plate registration slots are registered optically to the printing cylinder pins, in a position that minimizes the interference of magnetic forces. Following the registration of the plate's leading edge the "magnetic printing cylinder" is rotated to wrap around the entire plate. The ready for print cylinder is subsequently replaced in the press. This prior-art registration procedure is cumbersome and costly.

Another related requirement concerns CTP devices only, as these machines are designed for various sizes of media. The registration pins on the imaging cylinder must be replaceable and/or movable to conform to various standards of registration slots available in the art.

The invented registration method described herein solves the above mentioned constraints and offers an easy to operate, accurate and versatile method of mounting and registering Letterpress plates on "magnetic drum" imagesetters.

OBJECTS AND BRIEF SUMMARY OF THE PRESENT INVENTION

An object of the present invention is to provide an apparatus, and also a method, for an accurate and efficient registration and loading of ferromagnetic metal-based printing plates to a "magnetic drum", part of a CTP imaging system.

According to one aspect of the invention, there is provided an apparatus for registration and loading of ferromagnetic metal-based printing plates to a "magnetic drum", comprising: a magnetic cylinder equipped with "registration holes", designed to receive compatible "registration pegs";

a loading table, positioned to facilitate the loading of printing plates to said magnetic cylinder; a non-magnetic material spacer tray having geometrical dimensions compatible with at least one type of ferromagnetic metal-based printing plate, and thickness suitable for minimizing the magnetic attraction force; slots at the leading edge of said spacer tray, compatible in size and spacing with said drum registration holes, and at least one pair of registration pegs.

According to another aspect of the invention, there is provided a method for by operator registration and loading of ferromagnetic metal-based printing plates to a "magnetic drum", comprising: attaching a pre-punched ferromagnetic metal-based printing plate to a spacer-tray; placing said spacer tray with attached printing plate on the loading table; sliding forward said spacer tray with attached printing plate, leading edge first, towards the magnetic cylinder; using a first registration peg to register the plate's first punched registration hole to the cylinder's corresponding first registration hole; using a second registration peg to register the plate's second punched registration hole to the cylinder's corresponding second registration hole; rotating the cylinder clockwise to wrap and attach said ferromagnetic metal-based printing plate to said magnetic cylinder, and simultaneously releasing and removing said spacer tray, and removing said two registration pegs.

BRIEF DESCRIPTION OF THE DRAWINGS

The invention is herein described, by way of example only, with reference to the accompanying drawings, wherein.

DESCRIPTION OF A PREFERRED EMBODIMENT

Figure 3:
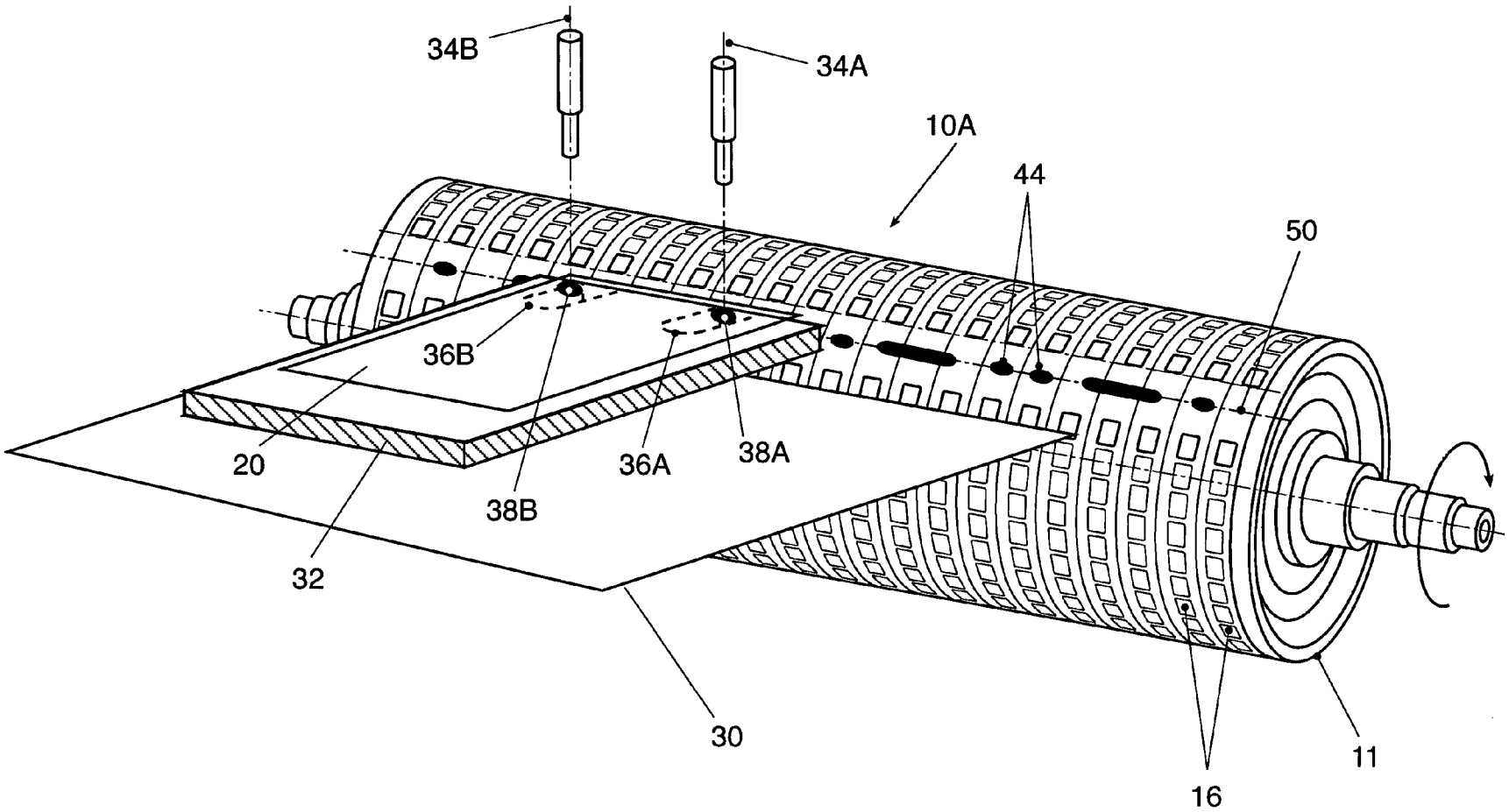
FIG. 3 illustrates schematically an apparatus for registration and loading of a Letterpress ferromagnetic metal-based plate to a "magnetic drum", part of a CTP imaging system.

FIG. 3 describes schematically the registration and loading of Letterpress ferromagnetic metal-based printing plate 20 to a "magnetic drum" 10A part of a CTP imagesetter (not shown).

Figure 1:
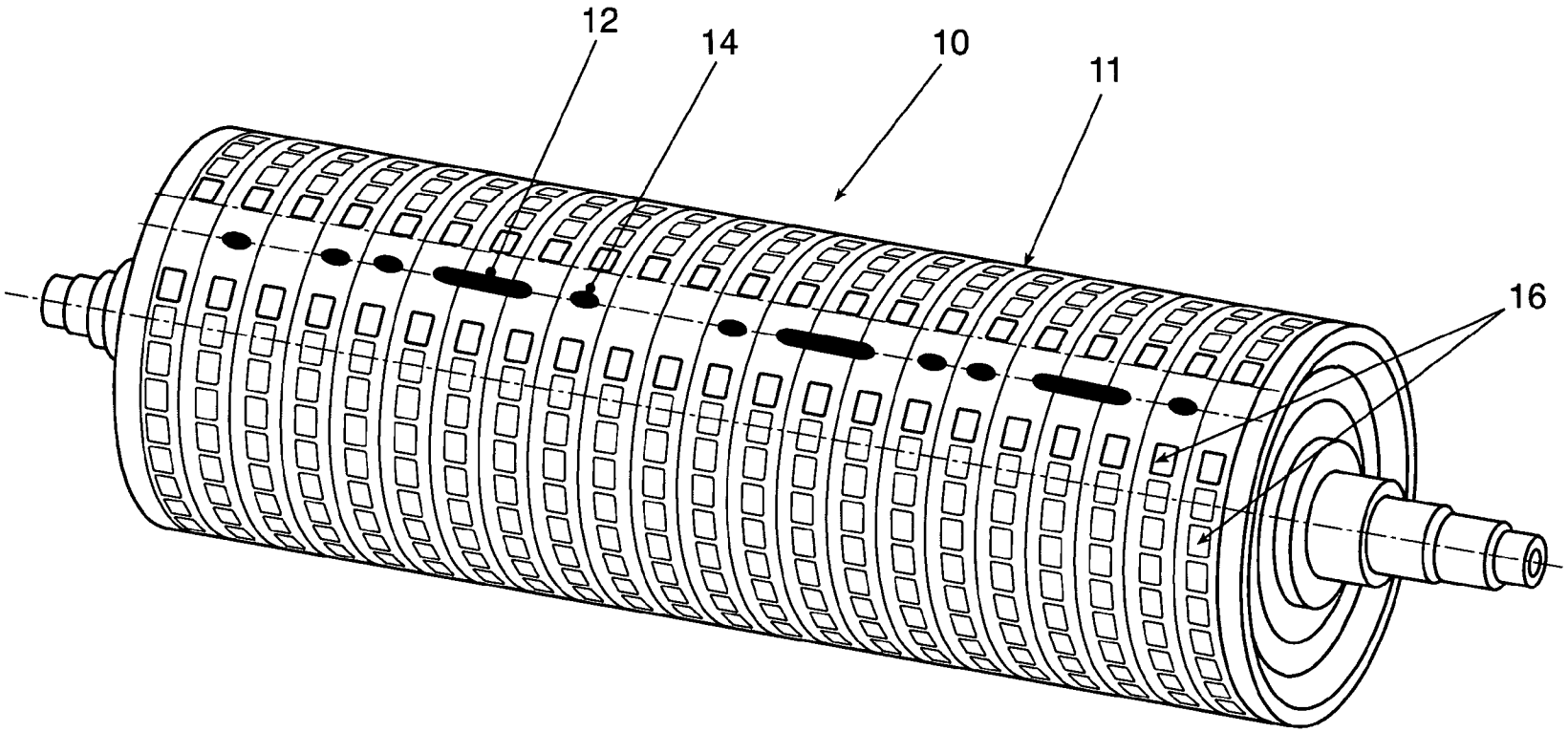
FIG. 1 illustrates a prior-art "magnetic drum"
Figure 2:
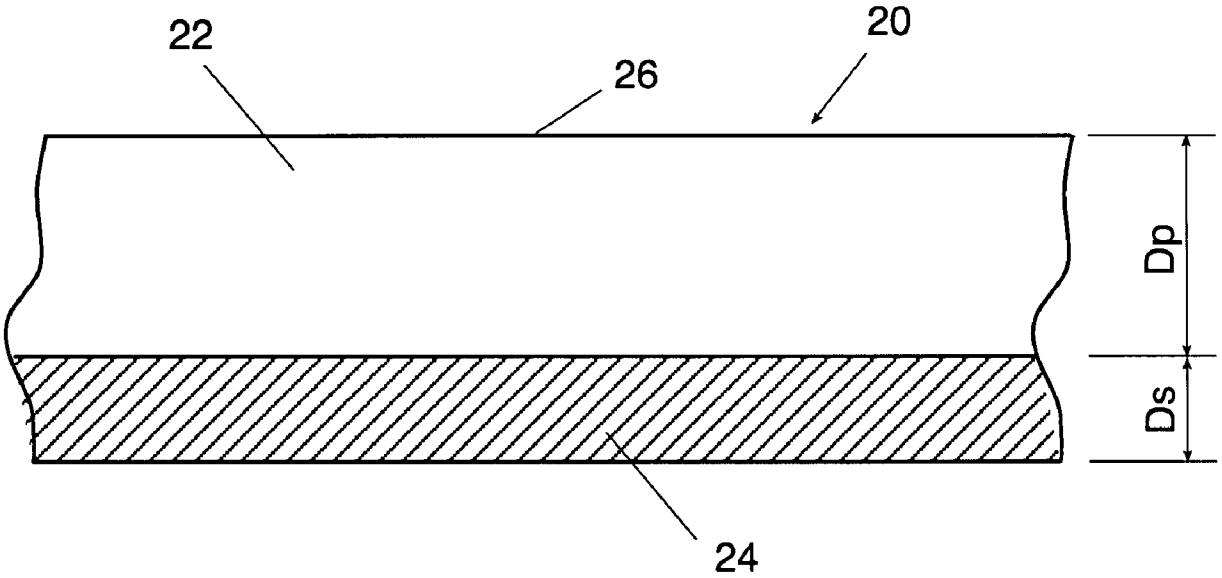
FIG. 2 illustrates a prior-art Letterpress printing plate.
Figure 4:
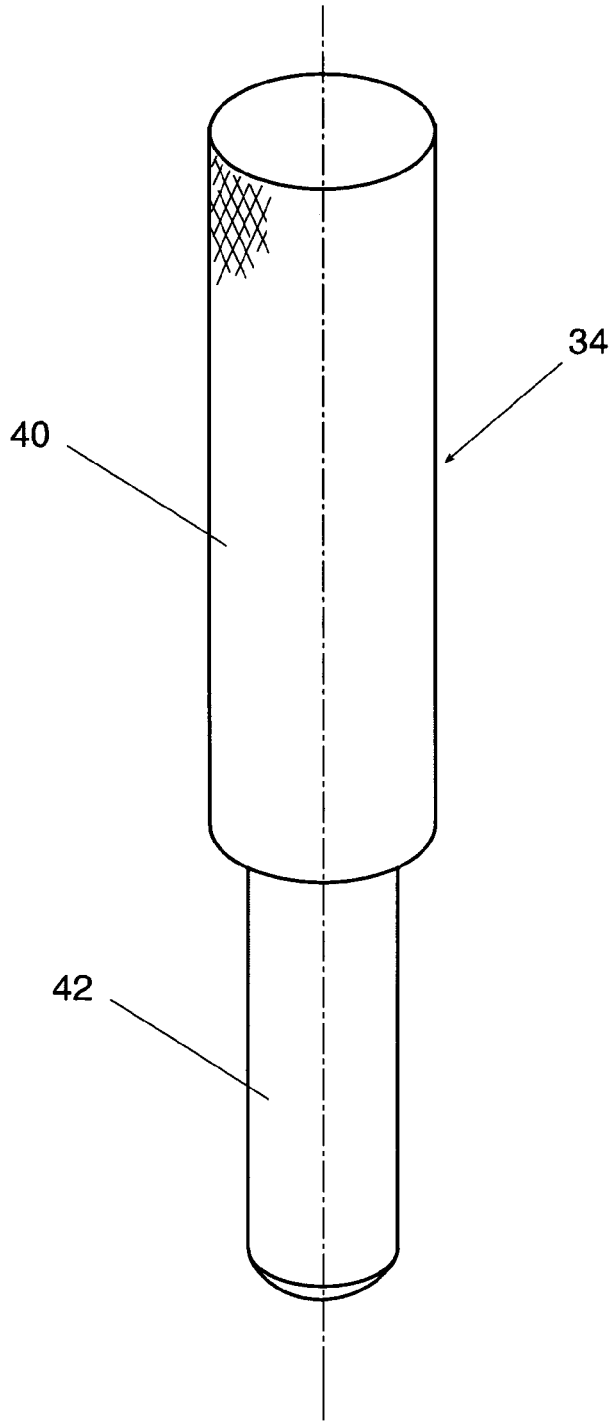
FIG. 4 illustrates schematically a "registration peg", as used in the apparatus of FIG. 3.

As known in printing plate imaging devices, for example, Creo's Thermoflex, the loading facility includes an aluminum table 30, which permits the operator to place the plate on top and manually manipulate the plate's leading edge to a convenient position for registration and loading. In a "vacuum drum" as used, for example, in Creo's ThermoFlex, short registration pins are mounted on the cylinder and the registration and loading operation is straight forward. In a hypothetical imagesetter to be designed for imaging Letterpress plates (or a dual purpose imagesetter designed for Letterpress ferromagnetic-metal and polyester based plates or Flexography plates) this operation will be a nightmare, as each time the operator will try to manipulate the ferromagnetic-metal based plate 20 on table 30 towards the cylinder 11 and its short registration pins 14 (as in FIG. 1), the leading edge of the plate would be "snatched" and locked by the strong magnetic field created by magnets 16. To remedy this problem a modified "magnetic drum" 10A is designed for the purpose of this invention (FIG. 3), where the registration pins 14 of FIG. 1 are replaced by "registration holes" 44 at the same coordinates and identical diameter. The "registration holes" are designed to receive "registration pegs" 34, which are schematically shown in FIG. 4. The peg 34 includes a round knurled handle 40 and a precision registration pin 42, identical in diameter to the known in the art registration pins discussed above. In operation, peg 34 will be manually inserted by the operator into the fitting registration holes 44.

Figure 5:
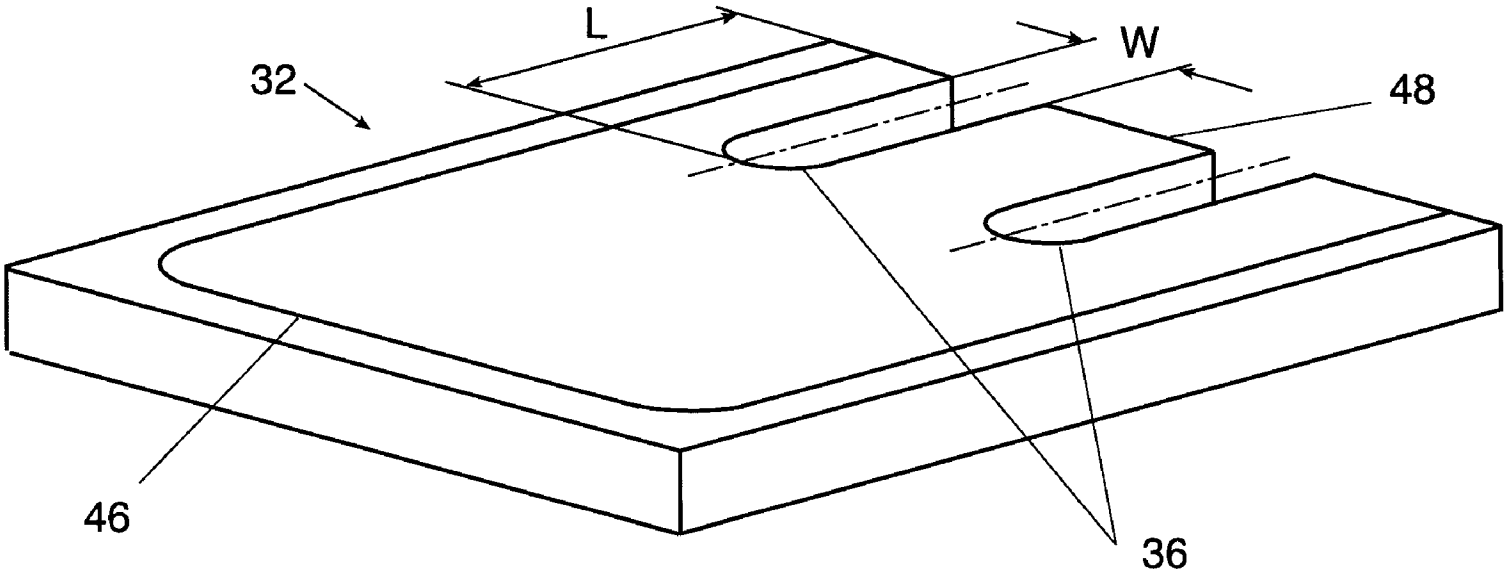
FIG. 5 illustrates schematically a spacer tray, as used in the apparatus of FIG. 3.

Another essential part designed to solve the problems outlined above is a non-magnetic, preferably plastic, tray 32, which will be used as a "spacer" to enable a smooth and precise registration procedure of the Letterpress ferromagnetic-metal based plate on "magnetic drum" 10A. Tray 32 is schematically depicted in FIG. 5. The dimensions of spacer-tray 32 conform the size of the Letterpress ferromagnetic metal-based plate 20 to be served, for example plate type BASF WS 73 D having dimensions of A mm long×B mm wide and 0.73 mm thick, will be served by a conforming spacer-tray having dimensions of A' mm long×B' mm wide, whereas A'>A and B'>B, and about 3.5 mm thick. The thickness dimension of the spacer-plate is selected to minimize the attraction force between magnets 16 and the ferromagnetic-metal-based plate to an acceptable level. Tray 32 can optionally include a recess 46, depending on the thickness of the plate served, which will help in positioning the plate on the spacer-tray. Open slots 36 are cut into the spacer-tray to permit the registration process as will be further explained. The dimensions L, W of the slot conform the types of registration holes 38 available in the plate/s served (note FIG. 3).

A single spacer-tray can be designed dimension wise to serve several types/sizes of plates, having common features, such as registration holes.

Figure 6:
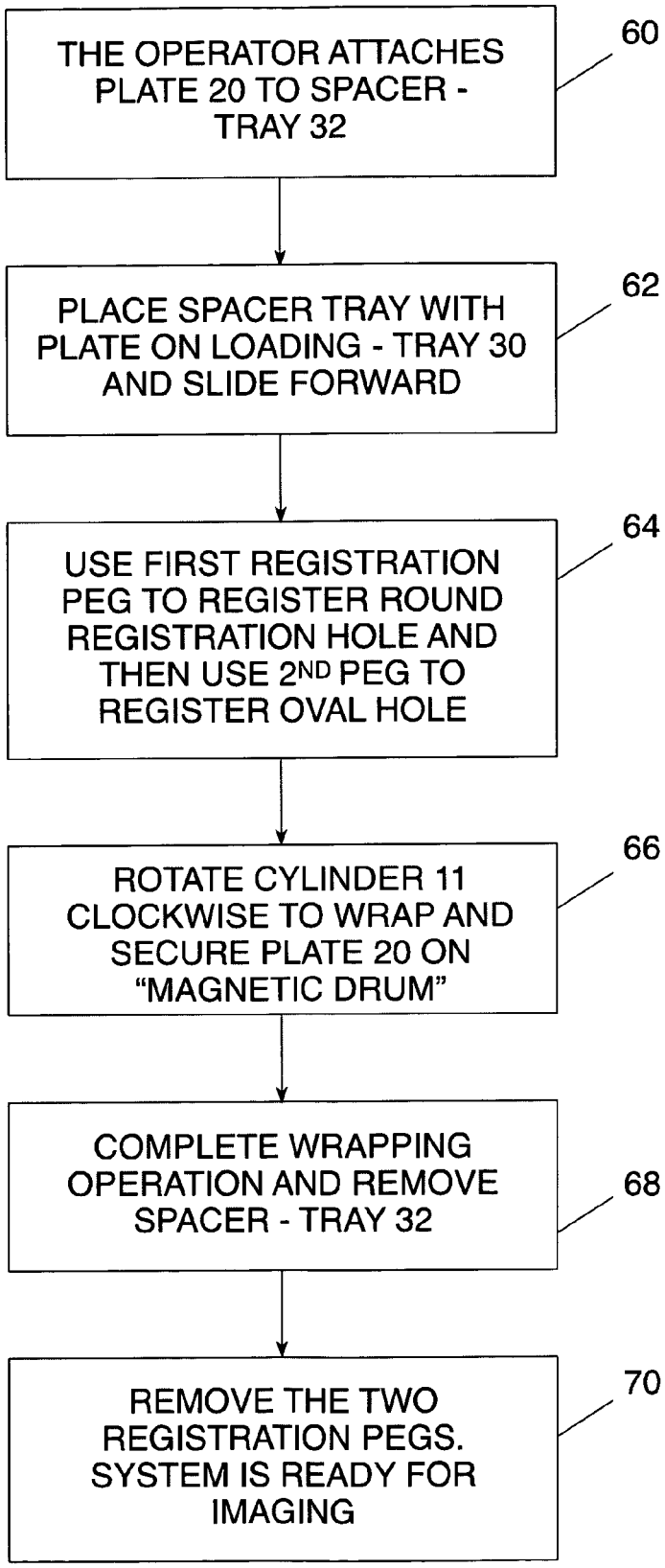
FIG. 6 is a schematic flow diagram describing the method of registration and attachment of a ferromagnetic metal-based plate to a "magnetic drum" of FIG. 3.

The registration and attachment of plate 20 to "magnetic drum" 10A will be schematically explained by FIGS. 3, 5 and flow diagram FIG. 6:

a. Step 60—The operator attaches the selected plate 20 to its corresponding spacer-tray 32. The leading edge of the plate should roughly correspond to the leading edge 48 of spacer-tray 32 but can protrude over the edge, provided the plate's registration holes 38A, 38B lay substantially over the tray open slots 36A, 36B.

b. Step 62—The spacer-tray and overlaying plate 20 are placed by the operator on loading table 30 and moved towards the "magnetic drum" 10A.

c. Step 64—When leading edge 48 of the spacer-tray 32 approaches the centerline 50 of the registration holes 44 the operator uses a first registration-peg 34A to locate and center the plate's round registration hole 38A through underlying slot 36A and one registration hole 44 of the cylinder. Once registration-peg 34A is firmly inserted, the operator uses a second registration-peg 34B to locate and center, as known in the art, the plate's oval registration hole 38B through underlying slot 36B and another registration hole 44 of the cylinder.

d. Step 66—Once the plate is registered, the operator slides back the spacer-tray 32 to close the gap between the plate leading edge and the surface of the cylinder and simultaneously manually rotates cylinder 11 clockwise, resulting in:

1. magnetic attachment of the leading edge of plate 20 and gradual wrapping on "magnetic drum" 10A;
2. the release of spacer-tray 32 from beneath plate 20.

e. Step 68—When plate 20 is completely wrapped and firmly mounted the spacer tray is free to be removed and the loading operation is basically completed.

f. Step 70—The two registration-pegs 34A, 34B are withdrawn and the system is readied for the imaging phase. Alternatively, the withdrawal of the two registration-pegs can be done (according to the plate's length) as soon as the plate is sufficiently wrapped around drum 10A.

To avoid the mistake of leaving the registration-pegs inserted in the "magnetic drum", at least two precautions can be taken:

paint the handle of the pegs in a conspicuous bright red or yellow attach the handles of both registration-pegs to the spacer-tray 32 using a flexible wire or chain.

The invented method of registration is valid for a wide range of ferromagnetic metal based Letterpress printing plates including a variety of registration holes standards, enabling the operator to mount such plates at a minimum time and maximum accuracy.

While the invention has been described with respect to a preferred embodiment, it will be appreciated that this is set forth purely for purposes of example, and that many other variations, modifications and applications of the invention may be made.

What is claimed is:

1. Apparatus for registration and loading of ferromagnetic metal-based printing plates, comprising:

a magnetic cylinder having registration holes;

a loading table;

a spacer tray of non-magnetic material; and at least one pair of registration pegs receivable in said registration holes;

said spacer tray having geometrical dimensions compatible with at least one type of said ferromagnetic metal-based printing plates, and a thickness suitable for minimizing the magnetic attraction force to said magnetic cylinder;

said spacer tray being formed with two slots at its leading edge compatible in size and spacing with said registration holes.

2. The apparatus according to claim 1, wherein each of said registration pegs includes a knurled handle, and a pin receivable in said registration hole.

3. The apparatus according to claim 1, wherein said loading table is positioned to facilitate the loading of said printing plates to said magnetic cylinder.

4. A method for registration and loading of ferromagnetic metal-based printing plates to a magnetic cylinder, comprising:

providing a magnetic cylinder having first and second registration holes, and at least one pair of registration pegs;

providing a loading table and a non-magnetic material spacer tray;

attaching to said spacer tray a pre-punched ferromagnetic metal-based printing plate having first and second registration holes;

placing said spacer tray with attached printing plate on said loading table;

sliding forward said spacer tray with attached printing plate, leading edge first, towards said magnetic cylinder;

using a first registration peg of said pair of registration pegs to register the plate's first punched registration hole to the cylinder's corresponding first registration hole;

using a second registration peg of said pair of registration pegs to register the plate's second punched registration hole to the cylinder's corresponding second registration hole;

rotating the cylinder to wrap and attach said ferromagnetic metal-based printing plate to said magnetic cylinder;

simultaneously releasing and removing said spacer tray, and removing said one pair of registration pegs from said cylinder.

5. The method according to claim 4, wherein said first punched registration hole is a round hole.

6. The method according to claim 4, wherein said second punched registration hole is an oval hole.

7. The method according to claim 4, wherein said rotating is clockwise.

* * * * *